United States Patent [19]

Rich

[11] Patent Number: 4,475,922

[45] Date of Patent: Oct. 9, 1984

[54] METHOD OF TREATING COAL FOR INCREASING THE AVAILABILITY OF COAL-FIRED BOILERS

[75] Inventor: Stanley R. Rich, Wellesley Hills, Mass.

[73] Assignee: Advanced Energy Dynamics, Natick, Mass.

[21] Appl. No.: 384,622

[22] Filed: Jun. 3, 1982

Related U.S. Application Data

[63] Continuation of Ser. No. 175,773, Aug. 6, 1980, abandoned.

[51] Int. Cl.[3] ..... C10L 9/00; F23D 1/00

[52] U.S. Cl. ..... 44/1 C; 110/342; 110/347

[58] Field of Search ..... 44/1 A, 1 B, 1 C; 110/342, 344, 347

[56] References Cited

U.S. PATENT DOCUMENTS 1,153,182 9/1915 Schniewind ..... 209/127 A
4,081,251 3/1978 Colli ..... 44/1 SR
4,155,313 5/1979 Moss ..... 110/347 X
4,397,248 8/1983 Mehta et al. ..... 110/347 X

FOREIGN PATENT DOCUMENTS 453457 9/1936 United Kingdom ..... 44/1 C

OTHER PUBLICATIONS

Fuels and Their Combustion, Haslam et al., McGraw-Hill Book Co., Inc., 1926, pp. 440-443.

*Primary Examiner*—Carl F. Dees
*Attorney, Agent, or Firm*—Wolf, Greenfield & Sacks

[57] ABSTRACT

After pulverizing feed coal to a range of particle sizes from 1 to 250 microns, the particles are divided at approximately a micron level in the range from 37 to 74 microns into a coarse fraction and a fine fraction. The inorganic material is separated from the organic material, at least in the coarse fraction, and the particles of inorganic material are excluded from the coal that is fed to the boiler.

6 Claims, No Drawings

METHOD OF TREATING COAL FOR INCREASING THE AVAILABILITY OF COAL-FIRED BOILERS

This is a continuation of application Ser. No. 175,773, filed Aug. 6, 1980 and now abandoned.

BACKGROUND OF THE INVENTION

An undesirable result of burning coal in boilers is the deposition of ash on heat exchanger surfaces, for example, in the superheater and reheater regions of steam generating units. Ash deposition adversely affects the reliability, availability and predictability of performance of coal-fired boiler units, in particular those which burn so-called "lower rank" coals. The ash component of coal consists of inorganic compounds of various compositions and properties. Whatever the composition or properties of a particular ash component may be, however, it is known that ash deposition rate can be reduced by (among other things) increasing the fineness of pulverized coal ("Technology and Use of Lignite'-'—Proceedings: Bureau of Mines—University of North Dakota Symposium, Grand Forks, N. Dakota, May 1-2 1969 —Bureau of Mines Information Circular 8471, pages 109-111). Fine particles in size ranges such that their motions in a gas stream are significantly governed by Stokes' Law, tend to follow the gas stream through the boiler and heat exchangers to and up the flue, where they can be captured in electrostatic precipitators or otherwise treated after leaving the boiler. In a gaseous medium, such as air, the motions of the very small particles of both coal and ash, many of which have essentially the same effective aerodynamic diameters, are governed essentially by Stokes' Law defining resistance to motion, $$R=6\pi nav$$

where "n" is the fluid viscosity, "a" is the radius of the particle (sphere), and "v" is the velocity of the particle.

Coarser particles tend to continue in straight-line paths, and do not readily follow the gas stream, and so they are more likely to impinge and deposit upon heat exchanger surfaces. The referenced publication illustrates, in FIG. 51 at page 109, that ash fineness has a tremendously important effect on particle impingment; increasing the fineness from 60 to 80 percent through a 200-mesh screen reduced the deposition by approximately one-half in a 30-minute exposure time.

If an electric power utility using coal-fired steam boilers is designed for 80% boiler availability and, due to being able to obtain only a poor quality coal having a higher-than-desired ash content, the boiler availability is reduced to 70%, the loss to the utility is one-eighth of its design rated power. Given a sales price of 5¢ per Kwh for its product, and a generating plant that is design-rated at 1000 megawatts for 80% boiler availability, the loss of revenue due to one-eighth decreased boiler availability is $150,000 per day!

One way to reduce the size of ash particles to a range in which boiler availability would be significantly increased would accordingly appear to be to pulverize the feed coal so fine that the largest size particle would become 74 microns (200 mesh), or perhaps 37 microns (400 mesh), but this procedure would introduce problems of cost and of handling particles as small as 2 or 3 microns which would be included in the feed coal. However, such a pulverization would result in a flame that would be substantially shorter and hotter than boilers are commonly designed for, resulting in inferior performance and possible damage to portions of the boiler. In addition, finer pulverization would require substantially greater energy. According to the present invention, it is not necessary to pulverize the feed coal so that all of it will pass a 200-mesh sieve.

GENERAL NATURE OF THE INVENTION

In accordance with the present invention, the availability of a coal-fired boiler is increased by excluding from the coal feed to the boiler at least those particles of the ash component which tend to deposit on the heat exchanger surfaces. In a preferred method, the feed coal is pulverized to a range of particle sizes from 1 to 250 microns, and is then divided, by standard sizing classifiers, at approximately a micron level in the range from 37 to 74 microns, into a coarse fraction and a fine fraction. This is done with a sieve between 400 and 200 mesh sieve sizes. "Forced-vortex" classifiers are available commercially which can be employed to perform the desired division at throughput rates required in full-scale industrial installations. Most of the particles of inorganic material, which constitutes the ash content of the coal, are then physically separated from the coal, at least in the coarse fraction, without using any liquid suspension medium. The step of physical separation is done in one of two ways; magnetic separation or electrostatic separation of particles of inorganic material from the particles of organic material. Thereafter, the separated particles of inorganic material are excluded from the coal that is fed to the boiler.

The new method of the invention is particularly valuable in its application to the removal of particles of inorganic material in the coarse fraction, since particles of inorganic material in the finer fraction, to the extent that they obey Stokes' Law, tend less to deposit on the heat exchanger surfaces of the boiler, and can be captured, e.g.: with electrostatic precipitators, before the flue gasses are vented to the surrounding environment.

Minerals, including pyrite, can be separated from coal by magnetic forces because the magnetic susceptibility of coal is negative—it is "diamagnetic". Coal will move away from magnets or highly magnetized poles or substances in a magnetic field. Its magnetic susceptibility is $-0.5\times10^{-6}$ cgs units. Pyrite and other minerals in the coal have positive susceptibility in the range of $+0.1$ to about $0.9\times10^{-6}$ cgs units. As a result, if coal is crushed so the minerals are separated from the coal into individual particles, passing the mixture through a high-gradient, high-intensity magnetic separator will cause the pyrite and other minerals to be captured by the magnetic field and separated from the coal which will pass out of the magnetic field. Magnetic separation, consequently, can be utilized to remove non-combustible components from coal. High-intensity, high-gradient separators are available commercially and can be obtained from several manufacturers in the United States.

The term "electrostatic separation" as used in this specification is intended to have the scope of meaning that is ascribed to it in "Chemical Engineers' Handbook", Robert H. Perry and Cecil H. Chilton, Editorial Directors; 5th Edition 1973, in the article entitled "Electrostatic Separation" at pages 21-62 to 21-6-5—McGraw Hill Book Company, New York, N. Y. The Electrical resistivity of inorganic minerals is substantially lower than the electrical resistivity of coal.

Dry bituminous coal has an electrical resistivity in the order of $10^{12}$ ohm cm. The minerals out of which ash is formed during combustion have an electrical resistivity between $10^6$ and $10^8$ ohm cm. In consequence, if bituminous coal is crushed and passed through an appropriately adjusted commercial electrostatic separator, most of the coal will flow into the "product" stream and most of the minerals will be collected in the "rejects" stream. Electrostatic separators suitable for this type of separation are described on the above referenced pages 21–62 through 21–65 of the Fifth Edition of the "Chemical Engineers' Handbook". Magnetic separators capable of performing the high-intensity, high-gradiency separations referred to above are described on pages 21–57 through 21–62 of the same reference.

I claim:

1. Method for improving combustion in a coal-fired boiler by excluding from the feed coal a substantial proportion of those particles of the ash component which during combustion tend to deposit on the heat-exchanger surfaces of the boiler, comprising the steps of pulverizing the feed coal to a range of particle sizes from 1 to 250 microns, dividing the pulverized coal at approximately a micron level in the range from 37 to 74 microns into a coarse fraction containing a substantial proportion of the particles of the ash component which during combustion tend to deposit on said heat-exchanger surfaces; and a fine fraction containing a substantial proportion of the particles of the ash component which during combustion tend to follow the gas stream through the boiler and heat-exchangers to and up the flue, and in the absence of liquid suspension medium, physically separating particles of inorganic material in the coarse fraction, and thereafter excluding the separated particles of inorganic material from the coal that is fed to the boiler while supplying both fractions of the pulverized coal to said boiler.

2. Method according to claim 1 in which the particles of inorganic material are electrostatically separated from the particles of organic material.

3. Method according to claim 1 in which the particles of inorganic material are magnetically separated from the particles of organic material.

4. Method of crushing and treating coal for improving combustion in a coal-fired boiler employing pulverized bituminous feed coal comprising the steps of crushing the coal to a range of particle sizes from 1 to 250 microns, selectively physically separating from the feed coal a substantial proportion of those particles of inorganic material larger than 37 to 74 microns in size which during combustion do not readily follow the gas stream in the boiler but tend to move in straight-line paths and impinge and deposit upon heat-exchanger surfaces so as to form ash deposits on the heat-exchanger surfaces of the boiler, and excluding said particles from the feed coal prior to combustion.

5. Method according to claim 4 including the step of electrostatically separating said particles of inorganic material from the feed coal.

6. Method according to claim 4 including the step of magnetically separating said particles of inorganic material from the feed coal.

* * * * *